US011476559B2

(12) United States Patent
Ghezzo et al.

(10) Patent No.: US 11,476,559 B2
(45) Date of Patent: Oct. 18, 2022

(54) COMBINED ANTENNA FOR SATELLITE AND TERRESTRIAL RADIO COMMUNICATIONS

(71) Applicant: HI-TE S.R.L., Goro (IT)

(72) Inventors: Enrico Ghezzo, Goro (IT); Antonello Giovannelli, Goro (IT)

(73) Assignee: HI-TE S.R.L.

( * ) Notice: Subject to any disclaimer, the term of this patent is extended or adjusted under 35 U.S.C. 154(b) by 11 days.

(21) Appl. No.: 16/968,590

(22) PCT Filed: Feb. 11, 2019

(86) PCT No.: PCT/IB2019/051081
§ 371 (c)(1),
(2) Date: Aug. 8, 2020

(87) PCT Pub. No.: WO2019/155433
PCT Pub. Date: Aug. 15, 2019

(65) Prior Publication Data

US 2021/0050648 A1 Feb. 18, 2021

(30) Foreign Application Priority Data

Feb. 12, 2018 (IT) ..... 102018000002581

(51) Int. Cl.
*H01Q 1/20* (2006.01)
*H01Q 1/24* (2006.01)
(Continued)

(52) U.S. Cl.
CPC ..... *H01Q 1/20* (2013.01); *H01Q 1/24* (2013.01); *H01Q 1/48* (2013.01); *H01Q 9/38* (2013.01);
(Continued)

(58) Field of Classification Search
CPC .. H01Q 1/20; H01Q 1/24; H01Q 1/48; H01Q 9/38; H01Q 21/26; H01Q 21/205; H01Q 21/30; H01Q 5/307
(Continued)

(56) References Cited

U.S. PATENT DOCUMENTS 2,819,463 A 1/1958 Vail et al.
3,665,478 A 5/1972 Dempsey
(Continued)

FOREIGN PATENT DOCUMENTS

WO 2014/102056 A1 7/2014

OTHER PUBLICATIONS

International Search Report, International Application No. PCT/IB2019/051081, dated Apr. 16, 2019, 4 pages.
(Continued)

*Primary Examiner* — Hai V Tran
(74) *Attorney, Agent, or Firm* — Ware, Fressola, Maguire & Barber LLP

(57) ABSTRACT

The combined antenna for satellite and terrestrial radio communications includes: a support structure (1); a "crossed dipole" compact broadband satellite antenna (10), in turn including a pair of dipoles (11,12), which extend from the support structure (1), and which are substantially perpendicular to each other and connected so as to be electrically out of phase. A broadband "monopole" antenna (50) for terrestrial communications is included, having a plurality of linear electric mass elements (52) extending radially from the support structure (1) to provide an electric mass surface (53), and a radiating arm (55) is also included extending from the support structure (1) away from the electric mass surface (53). The radiating arm (55) is arranged around the central column (2) and includes thread-like radiating elements (56); and the dipoles (11,12) further include one or
(Continued)

more thread-like dipole elements (111,112), arranged to define a flattened configuration of the respective dipole (11,12).

17 Claims, 5 Drawing Sheets

(51) Int. Cl.

| | |
|---|---|
| ***H01Q 1/48*** | (2006.01) |
| ***H01Q 9/38*** | (2006.01) |
| ***H01Q 21/26*** | (2006.01) |
| ***H01Q 21/30*** | (2006.01) |
| ***H01Q 21/20*** | (2006.01) |
| *H01Q 5/307* | (2015.01) |
| *H01Q 9/44* | (2006.01) |

(52) U.S. Cl.
CPC ..... *H01Q 21/205* (2013.01); *H01Q 21/26* (2013.01); *H01Q 21/30* (2013.01); *H01Q 5/307* (2015.01); *H01Q 9/44* (2013.01)

(58) Field of Classification Search
USPC ..... 343/727
See application file for complete search history.

(56) References Cited

U.S. PATENT DOCUMENTS

| | | | | |
|---|---|---|---|---|
| 4,864,320 | A * | 9/1989 | Munson | H01Q 19/06 343/834 |
| 5,173,715 | A * | 12/1992 | Rodal | H01Q 21/205 343/795 |
| 7,019,708 | B2 * | 3/2006 | Regala | H01Q 1/08 343/761 |
| 8,055,209 | B1 | 11/2011 | Dao | |
| 2005/0237256 | A1 | 10/2005 | Regala | |
| 2017/0149145 | A1 * | 5/2017 | Payne | H01Q 1/36 |

OTHER PUBLICATIONS

Written Opinion of the International Search Authority, dated Apr. 16, 2019, 7 pages.

* cited by examiner

COMBINED ANTENNA FOR SATELLITE AND TERRESTRIAL RADIO COMMUNICATIONS

TECHNICAL FIELD

The present invention relates to the technical field of radio frequency telecommunications. In particular, the invention concerns a combined antenna for satellite and terrestrial radio communications, respectively with circular and vertical polarisation, particularly suitable for mounting on land vehicles, boats, planes, or in any case on portable or transportable radio transmitting systems.

By way of example, the invention can be used in an advantageous way by a vehicle, typically a military vehicle equipped with a radio transmission system. The above case, although to be considered not limiting with respect to the application of the invention, envisages all the problems and needs that led to the conception of the invention. For this reason, in the following, the invention will be described with particular reference to the above mentioned application without excluding others, as already mentioned, for which its use and advantages are immediate and intuitive.

BACKGROUND ART

As for the example application of the invention, it is well known how important in the military environment is the use of terrestrial radio transmission devices (otherwise known as "LOS", acronym of "Line Of Sight") or of robust, reliable and stable radio-detection. A large part of the success of a mission or campaign depends on the perfect operation of the telecommunications network on the territory of the action. Mobile radio transmission systems equip specially designed vehicles or are installed on armored vehicles, battle tanks, aircrafts, helicopters or boats, to ensure maximum coverage of the territory. Other radio transmission systems, installed on non-self-propelled structures, may be self-transported or transported by air as required in the operative zone.

These systems are often designed to operate in a very wide frequency range, which generally ranges from a few tens to a few hundreds of MHz. For these frequency ranges, "monopole" antennas with vertical polarization and an omnidirectional radiation pattern in the horizontal plane are widely used. These antennas allow the communication between subjects which can be situated in any position in the territory. They have relatively compact dimensions, small footprint and a fair overall efficiency.

Technical Problem

Although it is possible to install several antennas operating in narrower frequency bands, the advantage of the possibility of covering the entire working frequency spectrum with a single antenna in an efficient manner is undeniable.

There are technical solutions aimed at extending the frequency spectrum covered efficiently by one antenna.

In particular, the so-called "monopole" antennas are suitable for this extension, that is, quarter wavelength ($\lambda/4$) resonant antennas that require the presence of a mass plane used to recreate the "missing" arm of the corresponding half wavelength dipole due to the known "image principle". Generally, in the case of narrowband monopole antennas, the radiating element is composed of a thin rod arranged vertically in the central part of a sunburst pattern (in the case of "transferred mass" version). In order to extend the bandwidth, the radiating element can be formed, according to known techniques, with a hollow cylinder of conducting material having a diameter not negligible in comparison to the length.

In this case the bandwidth useful for the antenna is a function of the diameter of the cylinder, and is defined by known semi-empirical formulas, from which it is derived that, starting from a thin conductor characterized by a ratio L/D=276, a 5 times increase of the ratio Length/Diameter causes an extension of the band to −3 dB of about 60%, and an about 30 times increase of the ratio of causes an about 3 times extension of the band to −3 dB.

For example, to obtain a useful band between about 30 MHz and about 1 GHz, necessary to cover most of the needs of medium-short range military transmission systems, a 500 mm long cylindrical radiating element with a diameter of 90 mm can be used. For a better adjustment of the impedance in the range 30 MHz to about 200 MHz, it may be useful to place an impedance converter between the antenna and the transceiver, made according to known techniques.

A further need, particularly strongly felt in the military field, to overcome the range limits inherent to LOS communication, is to take advantage of the availability of "bridge" satellites, and thus extend the range of action of mobile radio communications systems, or otherwise distributed throughout the territory. For this purpose, the above mentioned radio communication systems are provided, according to known techniques, with satellite transceivers ("SATCOM") suitably piloted and connected to other transceiver equipment, served by dedicated antennas.

Satellite radio communications equipment includes antennas normally having an omnidirectional radiation pattern in the horizontal plane and a circular polarisation coordinated with the direction of rotation of that of the antenna on board the satellite. Satellite antennas of this type are often of the crossed dipole type, i.e. including two crossed rods, arranged on the same horizontal plane, and electrically connected in such a way as to result in a 90 electrical degrees phase offset, and in this way they obtain the necessary circular polarization.

Combined antennas are known that aim at optimizing space requirements and overall dimensions, especially when these antennas are mounted on vehicles. The combined antennas include a LOS terrestrial antenna and a SATCOM satellite antenna installed on a single carrier to be mounted on the vehicle. In particular, according to a used technique, a crossed dipole antenna with 90 degrees electrical phase offset for SATCOM communications is combined with a monopole antenna for LOS communications.

At present, these combined antennas suffer from some drawbacks that may make them unadvisable to use, especially for operation in critical territorial conditions, when a wide range of operating frequencies is required for one or both antennas, and when these characteristics must be combined with imperative requirements of reliability and structural robustness.

OBJECTS OF THE INVENTION

The main object of the present invention is to propose a combined antenna for terrestrial (LOS) and satellite (SATCOM) radio communications capable of meeting all the needs described above, and thus overcoming the aforementioned drawbacks of the combined antennas currently available.

Another object of the invention is to propose a combined antenna in which both antennas have a high operating band.

A further aim is to propose a combined antenna which can ensure good coverage even in complex territorial situations, such as highly uneven terrain, mountain valleys or narrow gorges, and with bridge satellites positioned at high elevations with respect to the horizon, up to the vertical with respect to the antenna.

A still further object of the invention is to offer an extremely compact combined antenna, with a relatively simple construction, particularly robust and having a low coefficient of air penetration.

SUMMARY OF THE INVENTION

These and other objects are fully achieved by means of a combined satellite and terrestrial radio communications antenna which includes: a support structure; a so-called "crossed dipole" compact broadband satellite antenna, comprising in turn a pair of dipoles, which extend from the support structure and which are substantially perpendicular to each other and connected to each other so as to be electrically out of phase. It further comprises a broadband "monopole" antenna for terrestrial communications, in turn comprising a plurality of linear electric mass elements, which extend radially from the support structure. The linear mass elements are designed to provide an electric mass surface for said terrestrial communications antenna, and further comprises a radiating arm, that extends from said support structure away from the electric mass surface.

In particular, the radiating arm of the terrestrial communications antenna is arranged around the central column and is formed by a plurality of thread-like radiating elements; the dipoles further include one or more thread-like dipole elements arranged to define a flattened configuration of the respective dipole.

BRIEF DESCRIPTION OF THE DRAWINGS

The characteristic features of the invention will be evident from the following description of the preferred embodiments of the compact broadband antenna, according to the contents of the claims and with the help of the enclosed drawings, in which:

DESCRIPTION OF PREFERRED EMBODIMENTS OF THE INVENTION

Figure 1:
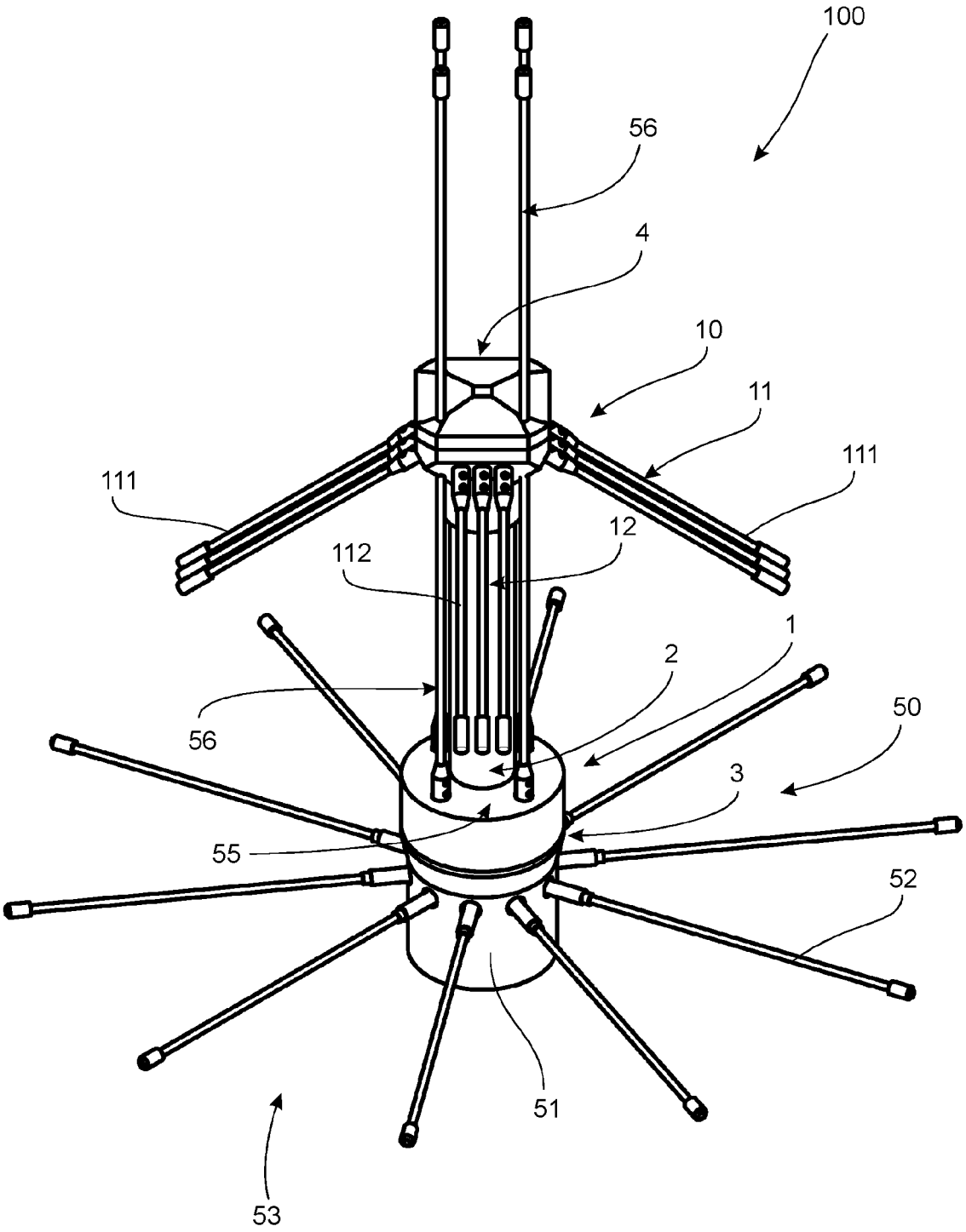
FIG. 1 is a perspective three quarters view of the combined antenna proposed by the invention, according to a first embodiment.

With reference to FIGS. 1 to 4, and to a first, but not sole embodiment of the invention, reference 100 indicates a combined antenna for terrestrial and satellite radio communications as a whole. The combined antenna 100 is mainly intended to be installed on vehicles, such as land vehicles, aircraft or boats, especially for military use, or in any case in areas, including civil ones, where it is necessary to exploit, as needed, terrestrial (LOS—Line of sight) and satellite (SATCOM) communication channels, and also particular compactness, robustness and reliability of the device is needed.

In particular, the combined antenna 100 according to the invention comprises, mounted on a single support structure 1, a so-called "crossed dipole" compact broadband satellite antenna 10, and a terrestrial communications antenna 50 of the "monopole" type, likewise wide-band.

The support structure 1, in particular, includes (see also FIG. 4) a central column 2, substantially formed by an elongated cylindrical tubular body, made of dielectric material.

A first base 3 made of dielectric material, likewise cylindrical, but with a larger diameter than the central column 2 is fastened at the lower end of the central column 2, with respect to the installation configuration of the antenna 100. The first base 3 consists of several components (see FIG. 4), the main of which are shown in the figure. When in the operational configuration, the components are fitted in to form packs. In particular, there are the following components: a perforated block 3*a*, provided with equidistant side holes; a support cup 3*b* designed to support the antenna connectors 19, 59, placed in the lower part of the perforated block 3*a*; a mass collector loop 3*c*, made of electrically conductive material and mounted inside it; a lower support adapter 3*d*, mounted above it; an upper support adapter 3*e*, which couples with the lower one 3*d* to enclose an RF cone 3*f* and at the same time acts as a fitting for the connection of the base 3 to the central column 2.

A second base 4 is provided at a distance from the aforesaid first base 3, and more precisely at the opposite end of the central column 2 with respect thereto. The second base is likewise made of dielectric material, has a substantially truncated pyramid shape and is fixed to the same central column 2 at its smaller base.

In particular, the first base 3 supports and is a part of the aforementioned antenna for terrestrial communications 50 (LOS), while the second base 4 supports and is a part of the aforementioned satellite antenna 10 (SATCOM), according to the procedures described below.

As already mentioned, the LOS 50 antenna is of the monopole type and includes an electric mass surface (which will be indicated later on as "mass plane", even if this surface does not have to be flat) 53, and the monopole radiating arm 55, which is its active part.

The mass plane 53 is formed by a plurality of electric mass linear elements 52 made by as many steel strands, ten in the illustrated embodiment. In the LOS antenna 50, this number has been empirically determined as the best compromise between efficiency and construction simplicity, however this number may be greater or smaller depending on different specific needs.

Each strand 52 extends radially from the lateral surface of the aforementioned first base 3, equidistant from the preceding and following strands 52. The electrical continuity between the strands 52 of the mass plane 53 is ensured by the above described ground collector loop 3*c*.

In monopole antennas, the "missing" part of the dipole is replaced by its image in the mass plane. In this case, the mass plane is of the "transferred" type, in the sense that it is independent of any mass plane possibly present at the installation site. The so made mass plane 53 is particularly effective and strong.

The mass plane 53 is electrically connected to the mass of a power supply RF connector 59 (shown in the exploded view of FIG. 4 in unconnected mode, for the sake of illustrative clarity), for example of BNC type and is an integral part of the LOS antenna 50, as the aforementioned mass plane 53 establishes the conductive path for the reclosing of the radiofrequency currents supplying the monopole. Moreover, the presence and geometric characteristic of the mass plane 53 creates the input impedance, making it substantially independent from the presence, or absence, of a metal surface at the antenna 50 installation site.

The radiating arm 55 of the 50 antenna is configured to provide the LOS antenna 50 with a wide operating band, in particular at lower frequencies, and limited aerodynamic resistance, while remaining particularly robust, especially in the case of accidental impacts, due to the use of conductive and flexible steel strand.

For this purpose, the radiating arm 55 includes a plurality of radiating elements 56, each of which consists of a linear conductive strand. The radiating elements 56 are mounted equidistant in the upper part of the first base 3, and more precisely in the upper fitting 3*e* described above, and advantageously arranged along the ideal lateral surface of a cylinder, coaxial and external to the central column 2.

In essence, since it is known that the useful bandwidth of a monopole, especially at low frequencies, is as much as the diameter of its radiating arm, and is maximum when such radiating arm consists of a continuous cylindrical surface, the radiating elements are mounted as far as possible from the axis of the central column 2, and at generators of that cylindrical surface. In this way, their radiation pattern, in terms of bandwidth, approximates to that produced by a radiating arm consisting of a continuous cylinder, the bigger number of radiating elements 56 the greater approximation of the pattern.

The illustrated embodiment provides four radiating elements 56, but their number can vary according to the needs of use, considering that a greater number of radiating elements 56 corresponds to a better approximation of the frequency behavior of the continuous cylinder, at the expense of the overall aerodynamics of the combined antenna 100 and the simplicity of construction.

In general, longer radiating elements 56 extend the operating band more towards the lower VHF frequencies, while shorter radiating elements 56 give rise to an operating band extending more towards the UHF frequencies. A particular flexibility of the management of the useful band of the LOS antenna 50 realized according to the invention is given by the fact that the radiating elements can have different lengths, to enclose an extended frequency spectrum, both towards the VHF band and UHF band.

According to an alternative embodiment of the invention, the radiating elements 56 of the LOS antenna 50 are arranged along a lateral surface of a truncated cone geometric figure having its minor base at the aforementioned first base 3 supporting the radiating elements 56. It has been experimentally verified that this configuration is advantageous in terms of reduction of SWR, that is, the standing wave ratio, in particular in the part of the antenna operating band which corresponds to an interval approximately extending between 200 and 500 MHz (UHF).

The part of the combined antenna 100 of the invention that corresponds to the antenna for satellite communications (SATCOM) 10, as already mentioned of the cross dipole type, comprises a pair of identical dipoles 11, 12, which extend from the second base 4 crossing in the center of the second base 4. The dipoles 11,12 are connected to each other, according to the technique known in this type of antenna, with a 90 electrical degrees phase offset, by means of an electrical phase offset circuit 18 (FIG. 4) and then connected to the transmission system that drives the antenna through a known RF connector 19, which comes out from the bottom of the antenna 100. In essence, the electrical phase shift circuit 18 distributes the power coming from the transmitter in equal parts among the dipoles 11, 12 and applies it to the crossed dipoles 11, 12 with a 90 electrical degrees phase offset.

In particular, according to an aspect of the invention, each of the above mentioned dipoles 11, 12 includes a plurality of dipole elements 111, 112, arranged side by side in such a way as to configure the relative dipole 11, 12 in a way that reproduces a flattened surface. In the example embodiment, the elements are arranged side by side and parallel, however other configurations that represent not flattened surfaces with not parallel elements are considered as variants of this example, presenting similar advantages and meeting different needs of mere construction. Moreover, each dipole 11, 12 is divided into two parts, respectively 13*a*, 13*b*; 14*a*, 14*b*, likewise identical, each of which is fixed to one end of the side wall of the second base 4 in a direction orthogonal to those adjacent thereto. The parts 13*a*, 13*b*; 14*a*, 14*b* are opposite to each other and are kept in electrical continuity by means 13*a*, 13*b*; 14*a*, 14*b* of suitable connections provided inside the second base 4.

According to an aspect of the invention, each of the dipole parts 13*a*, 13*b*; 14*a*, 14*b* has a flattened configuration. According to the measurements, this configuration allows to obtain an enlarged operating band with respect to conventional crossed dipoles of single thread-like or cylindrical elements, maintaining an extremely low aerodynamic profile.

In particular, in the illustrated preferred embodiment, each part of the dipole consists of a plurality of flexible metal strands, arranged side by side and equidistant, which ensure also a strong resistance to accidental impacts. As far as the functionality and performance of the radio frequency antenna SATCOM 10 are concerned, each part of the dipole could be composed of a properly shaped metal plate, to form a continuous conductive surface. However, replacing this surface with a plurality of strands allows the construction of the antenna to be simplified, lighter, more resistant to shocks, and substantially the performance can be maintained in terms of operating bandwidth that would be obtained with the continuous surface.

To better clarify what is described above, in the complex configuration of the dipoles 11, 12 described above, each cited element of dipole 111, 112 is divided between two opposite parts (13*a*, 13*b*; 14*a*, 14*b*) of its own dipole 11, 12. This must be specified because, in a different embodiment of the invention, the dipoles 11, 12 could be made in a single body instead of divided into parts.

Figure 2:
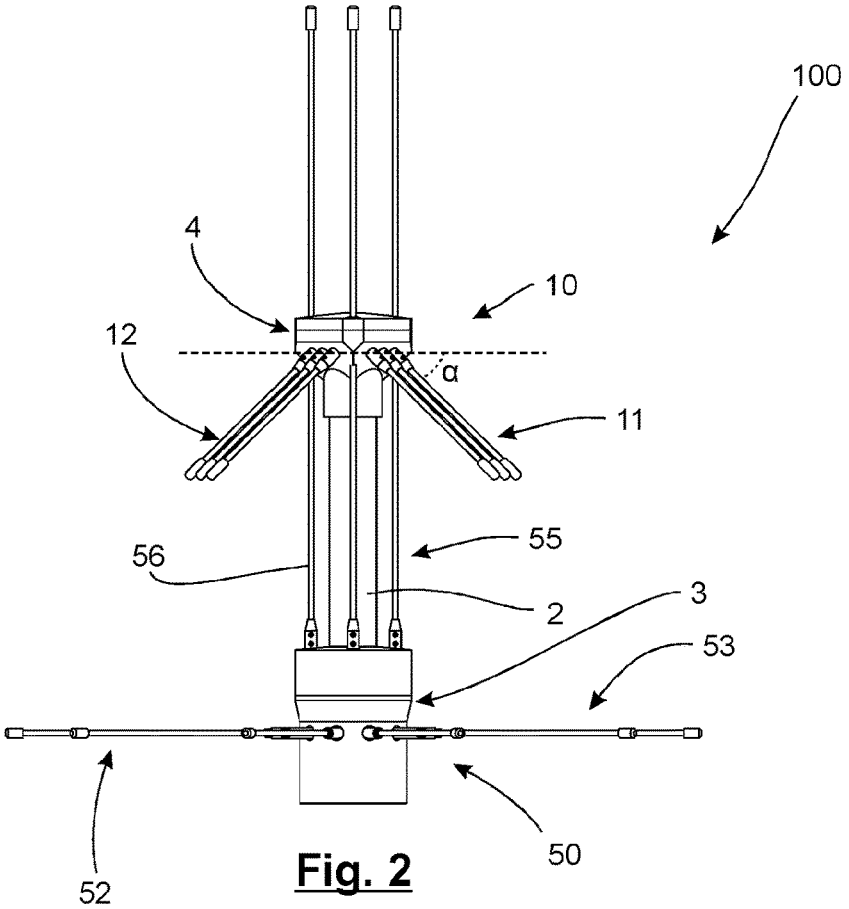
FIG. 2 is a side view of the combined antenna as shown in FIG. 1.
Figure 3:
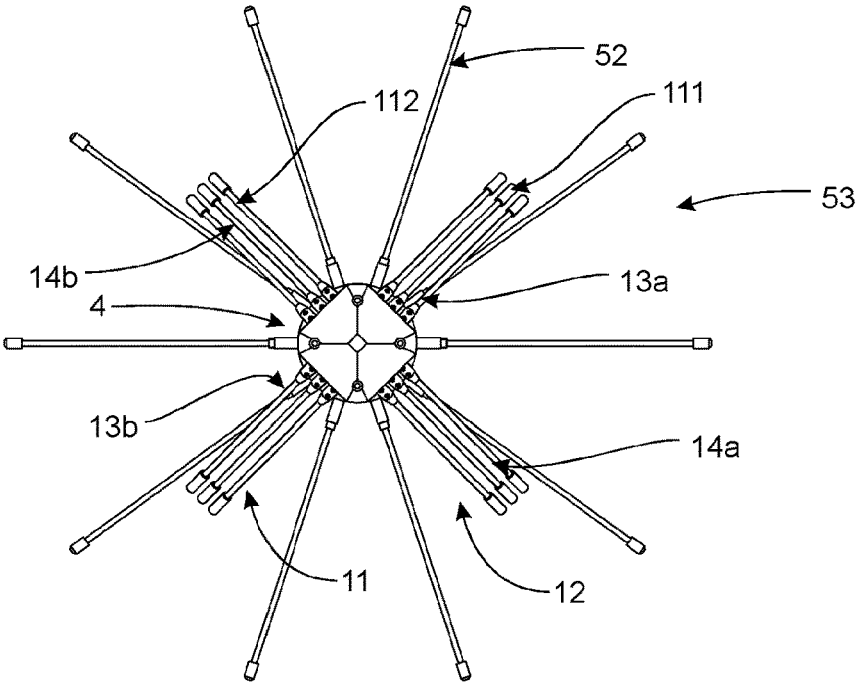
FIG. 3 is a top view of the combined antenna of the previous figures.
Figure 4:
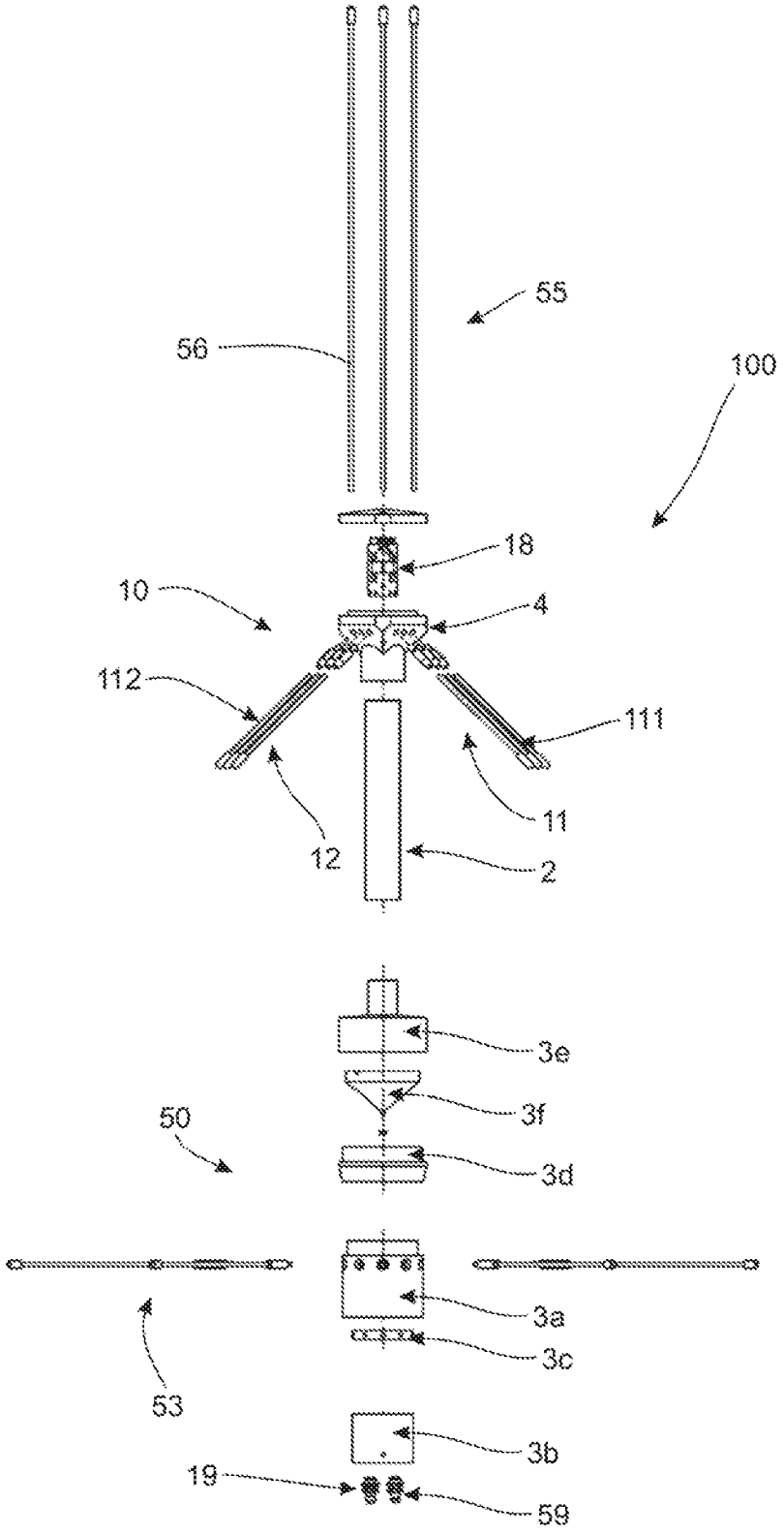
FIG. 4 is an exploded view of the combined antenna of the previous figures.

In any case, according to another aspect of the invention, each dipole part 13*a*, 13*b*; 14*a*, 14*b* extends from the side wall of the second base 4 with an inclination angle ($\alpha$) of 35° with respect to a plane perpendicular to a longitudinal axis of the support structure 1, downwards, that is towards the base of the combined antenna 100 (see FIG. 2). This inclination, although not crucial for the performance of the SATCOM antenna 10, ensures a radiation impedance of the antenna 10 close to 50 Ohm.

The fact that the two dipoles 11, 12 have a radiation impedance close to 50 ohms makes it advantageously possible to use a power divider 18 made according to the known technique providing −3 db coupled lines, commonly called "90 degrees hybrid splitter circuit".

In this way, due to the consequent circuit simplicity, all the transmission lines of the power system work at 50 Ohms, which eliminates the need to provide impedance transformations that could lead to power losses and deformations of the radiation diagram.

The use of a 90 degrees hybrid splitter 18 allows an advantage in terms of impedance adaptation even outside the bandwidth, already wide, ensured by the shape of the dipoles 11, 12 as described above. This is due to the fact that the power reflected by the two dipoles 11, 12 towards the output ports of the hybrid divider 18, having identical amplitude and phase because the dipoles have the same construction, and having a further 90 electrical degrees offset, is applied to a 50 Ohm resistive termination present at the output port of the hybrid divider with a 180 electrical degrees offset. This is an advantage from the point of view of protection of the transmitter's output power stage, since possible reflected power would be diverted to the resistive termination without causing malfunctions or damage.

In any case, the 35 degree value of the inclination of the dipole parts is not critical, since the advantages described above can also be obtained significantly for different inclination angles, for example between 10 and 45 degrees.

According to a characteristic of the first embodiment of the invention described here, (see FIG. 1) the radiating elements 56 of the LOS antenna 50 extend beyond the aforementioned second base 4 of the SATCOM 10 antenna support. In this case, they are advantageously passed inside the second base 4, through the relative through holes made in it. In this way radiating elements 56 can be set up with the desired length without interfering with the crossed dipoles 11, 12 of the SATCOM antenna 10. This configuration allows for a greater extension of the lower part of the bandwidth of the LOS antenna, thus creating more favourable conditions for it with respect to the upper part of the band.

In a second embodiment of the combined antenna, shown in FIGS. 5, 6, 7 and 8 and preferable with respect to the first embodiment in case of special bandwidth management requirements, the length of the radiating elements 56 of the LOS antenna 50 is defined in such a way that they do not reach the second base 4 of the SATCOM antenna 10 support. Such a dimensioning of the radiating elements 56 supports the efficiency of the LOS antenna 50 in the highest part of the operating frequency band thereof.

In order to define and maintain an optimal operating position of the design (FIGS. 5 and 7) for the radiating elements 56, as many perforated brackets 57 have been made in the upper part of the central column 2 extending horizontally therefrom.

Therefore, the end parts of the radiating elements 56 pass through the holes of the respective perforated brackets 57, and are held in place thereby.

In this way, defining appropriately the distance of the holes of the brackets 57 from the surface of the central column 2, the operating geometry of the radiating elements 56 can be designed. As already described with reference to the first embodiment of the invention, the latter can be provided to stay on the lateral surface of an ideal cylinder, or of a truncated cone surface, depending on specific needs.

Figure 5:
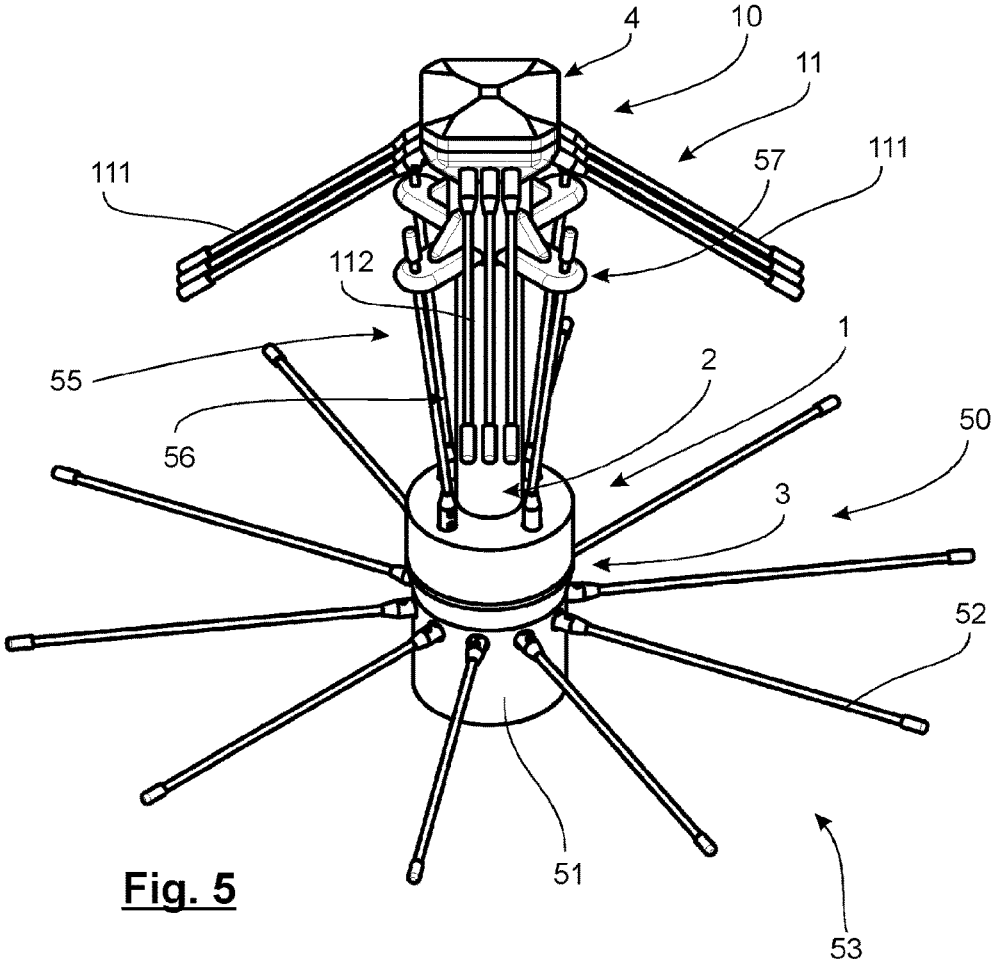
FIG. 5 is a perspective three quarters view of the combined antenna proposed by the invention, according to a second embodiment.
Figure 6:
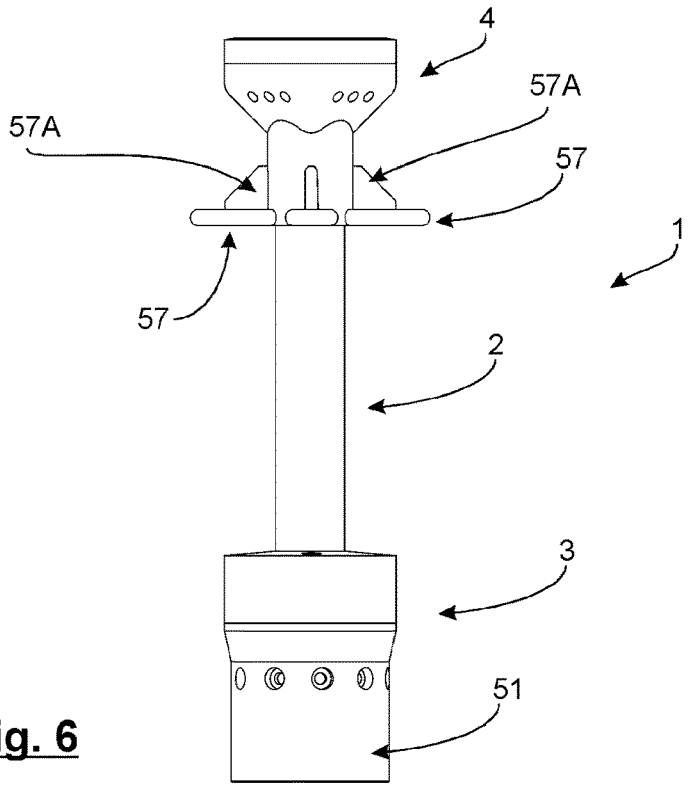
FIG. 6 shows a detail of the support structure of the combined antenna shown in FIG. 5.
Figure 7:
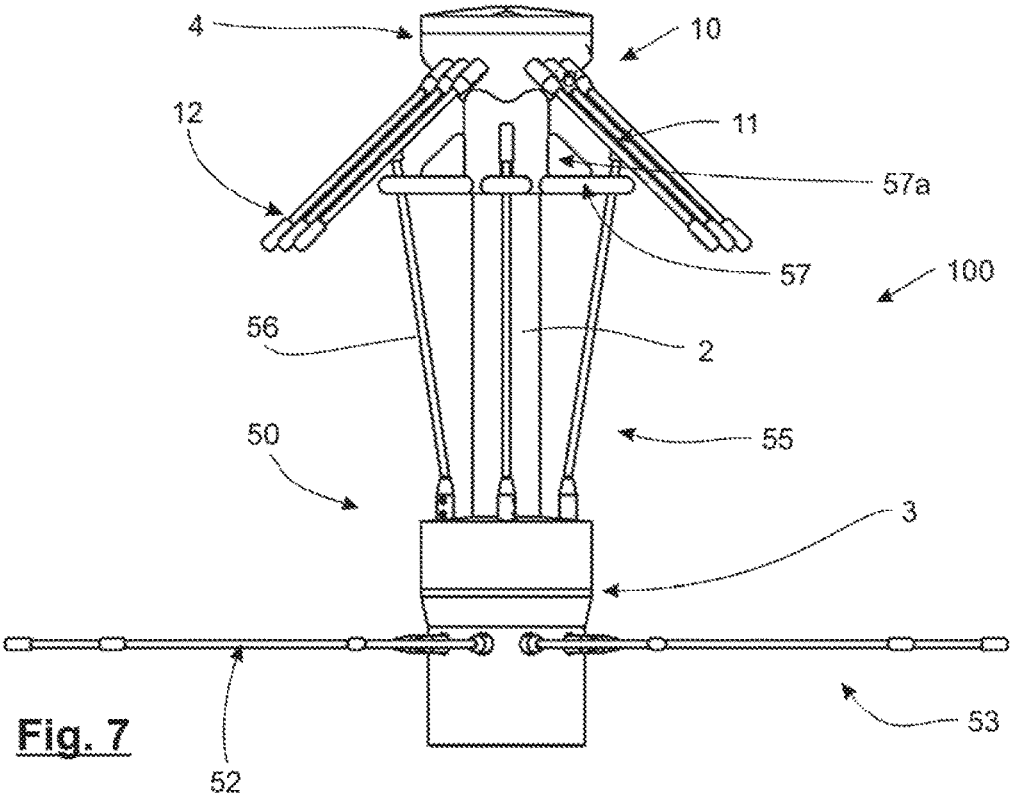
FIG. 7 is a side view of the combined antenna as shown in FIG. 5.
Figure 8:
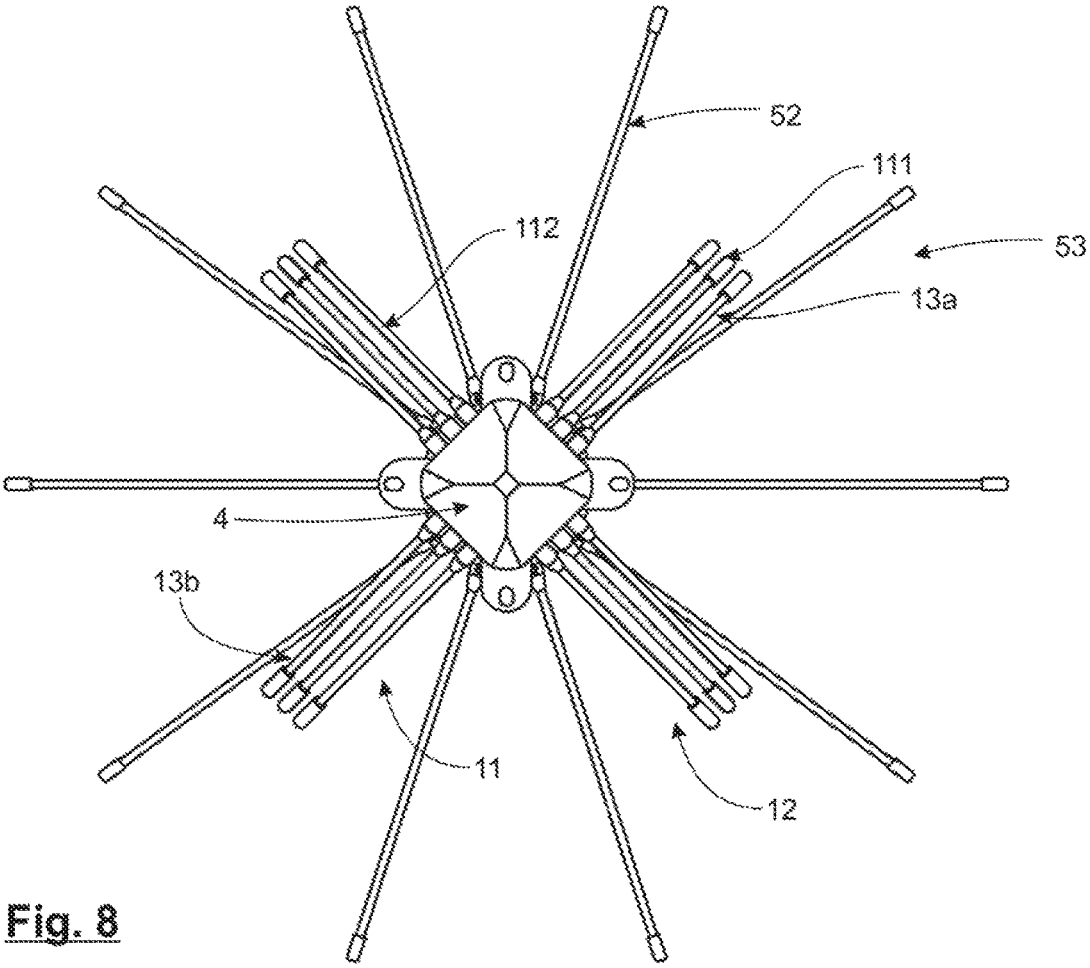
FIG. 8 is a top view of the combined antenna of FIG. 5.

In particular, the arrangement of the radiating elements 56 according to a truncated-cone geometry can be appreciated in FIGS. 5 and 7.

Moreover, a reinforcement 57A is provided for each bracket 57 (FIG. 6) to improve the structural rigidity of the LOS antenna 10.

According to a further feature, not illustrated as it is simple to understand and applicable to all the embodiments described above, the combined antenna 100 further comprises a GPS receiver, or an antenna for GPS receiver, mounted at top of the aforesaid antenna 100, at the aforementioned second base 4.

The particular construction of the combined antenna 100 also makes it possible to provide it in an exclusively terrestrial or exclusively satellite configuration, in a likewise advantageous way.

For this purpose, the radiating elements 56 and the electric ground elements 52 of the mass plane 53 of the LOS antenna 50 as well as the dipole elements 111, 112 of the crossed dipoles 11, 12 of the SATCOM antenna 10 are advantageously mounted in a removable manner, for example in a reversible snap fit with threaded couplings.

In this way, in order to obtain an exclusively terrestrial antenna 100, it is sufficient to avoid installation of the crossed dipoles 11, 12, the relative power divider 18 and the RF connector 19.

On the other hand, to obtain an exclusively satellite antenna 100, it is sufficient to exclude the radiating elements 56 and the sunburst linear ground elements 52, in addition to the corresponding connector 59.

The particular constructive simplicity of the combined antenna 100 allows, in case of need, to switch from one configuration to another even after installation, provided that the supplied version includes the necessary connectors and internal circuitry that can remain in its seat. In case of particular operational needs, it is also possible to remove one or more removable parts from the combined antenna 100 provided in its complete configuration.

Finally, in the exclusively satellite configuration, it is possible to maintain the above mentioned rays of linear mass elements 52. In fact, the mass plane consisting of the sunburst conductors represents a reflective plane for the SATCOM antenna 10, for which it determines and stabilizes the radiation pattern on the vertical plane even in the case of installations on non-metallic surfaces.

In any case, in the combined antenna according to the invention, both antennas have a very wide operating frequency band. In the exemplifying application range, the operating band of the LOS section extends from 180 MHz to 520 MHz without the need to adjust impedance, and goes further downwards up to 30 MHz using an impedance adjustment circuit made according to known techniques. The operating band of the satellite section extends from 200 MHz to 350 MHz including the SATCOM band, without the need to adjust impedance.

It is understood, however, that what is described above is illustrative and not limiting, therefore any variations of details that may be necessary for technical and/or functional reasons are considered from now on within the protective scope defined by the claims below.

The invention claimed is:

1. Combined antenna for satellite and terrestrial radio communications, of the type including:

a support structure (1);

a compact broadband satellite crossed dipole antenna (10) comprising a satellite antenna radio frequency connector (19) and a pair of dipoles (11, 12) connected to said satellite antenna radio frequency connector (19), wherein the pair of dipoles extend from the support structure (1), are substantially perpendicular to each other, and are connected to each other so as to be electrically phase-offset; and a broadband monopole antenna (50) comprising a terrestrial radio frequency connector (59) for terrestrial communications and further comprising a plurality of linear electric mass elements (52), that extend radially from said support structure (1), said linear electric mass elements (52) providing a surface of electric mass (53) for said broadband antenna (50) for terrestrial communications, and further comprising at least one radiating arm (55) of the monopole antenna, which extends from said support structure (1) away from said surface of electric mass (53);

said support structure (1) comprising a central column (2), a first base (3), mounted on said central column (2) and a second base (4), likewise mounted on said central column (2) and spaced apart from said first base (3); said linear electric mass elements (52) mounted laterally in said first base (3) and said at least one radiating arm (55) of said monopole antenna (50) for terrestrial communications mounted thereabove, the at least one latter radiating arm (55) arranged around said central column (2); wherein each dipole of said pair of dipoles (11, 12) of the aforementioned compact broadband satellite crossed dipole antenna (10) is mounted sideways and crosswise with respect to the other in said second base (4), each dipole comprising one or more dipole elements (111, 112) arranged to define a flattened configuration and wherein the combined antenna is configured as a whole to communicate terrestrial communication channels and satellite communication channels, respectively, via said terrestrial radio frequency connector (59) and said satellite antenna radio frequency connector (19).

2. The combined antenna according to claim 1, wherein each of said one or more dipole elements (111, 112) comprises a plurality of metal strands placed side by side and equidistant.

3. The combined antenna according to claim 1, wherein each element of said dipole elements (111, 112) of said broadband satellite crossed dipole antenna (10) comprises an elongated metal plate.

4. The combined antenna according to claim 1, wherein each of said one or more dipole elements (111, 112) extends from the second base (4) at an inclination angle ($\alpha$) with respect to a plane perpendicular to a longitudinal axis of said support structure (1), comprised between 10° and 45°.

5. The combined antenna according to claim 4, wherein said inclination angle ($\alpha$) is 35°.

6. The combined antenna according to claim 1, wherein each dipole of said pair of dipoles (11, 12) of said satellite antenna (10) is divided into two identical parts (13*a*, 13*b*; 14*a*, 14*b*), each identical part extending laterally from the second base (4) of said support structure (1) in a direction that is orthogonal to the direction of adjacent identical parts of the other dipole.

7. The combined antenna according to claim 6, wherein one or both of the two identical parts (13*a*, 13*b*; 14*a*, 14*b*) comprises a plurality of metal strands placed side by side and equidistant from one another.

8. The combined antenna according to claim 6, wherein one or both of said two identical parts (13*a*, 13*b*; 14*a*, 14*b*) of said satellite antenna (10) comprises an elongated metal plate.

9. The combined antenna according to claim 6, wherein each of said identical parts (13*a*, 13*b*; 14*a*, 14*b*) extends from the second base (4) at an inclination angle ($\alpha$) with respect to a plane perpendicular to a longitudinal axis of said support structure (1), the inclination angle ($\alpha$) comprising between 10° and 45°.

10. The combined antenna according to claim 9, wherein said inclination angle ($\alpha$) is 35°.

11. The combined antenna according to claim 1, wherein said radiating arm (55) of said monopole antenna (50) for terrestrial communications comprises a plurality of radiating elements (56) that are arranged around said central column (2).

12. The combined antenna according to claim 11, wherein said radiating elements (56) comprise linear, equidistant and parallel rods.

13. The combined antenna according to claim 11, wherein said radiating elements (56) extend beyond the second base (4) of the support structure (1), through corresponding through holes made in the second base (4).

14. The combined antenna according to claim 11, wherein said radiating elements (56) are arranged along a frustoconical lateral surface that has a minor base at the first base (3) supporting the radiating elements (56).

15. The combined antenna according to claim 11, wherein a plurality of perforated brackets (57) are provided in the upper part of said central column (2), and a terminal part of each of said radiating elements (56) extends through a perforation of a respective perforated bracket (57).

16. The combined antenna according to claim 1, further comprising a GPS receiver, mounted near or at a top part of said combined antenna (100).

17. The combined antenna according to claim 1, wherein said linear electric mass elements (52), said radiating arm (55) and said one or more dipole elements (111, 112) are removably mounted on said support structure (1).

* * * * *